US009601876B2

(12) United States Patent
Jiang et al.

(10) Patent No.: US 9,601,876 B2
(45) Date of Patent: Mar. 21, 2017

(54) ELECTRICAL CONNECTOR ASSEMBLY

(71) Applicant: LOTES CO., LTD., Keelung (TW)

(72) Inventors: Xiao Di Jiang, Keelung (TW); Da Ling Fang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/866,045

(22) Filed: Sep. 25, 2015

(65) Prior Publication Data

US 2016/0261056 A1 Sep. 8, 2016

(30) Foreign Application Priority Data

Mar. 4, 2015 (CN) ..... 2015 2 0125120 U

(51) Int. Cl.

| | |
|---|---|
| ***H01R 13/648*** | (2006.01) |
| ***H01R 13/6585*** | (2011.01) |
| ***H01R 12/72*** | (2011.01) |
| ***H01R 24/50*** | (2011.01) |
| ***H01R 24/62*** | (2011.01) |
| *H01R 103/00* | (2006.01) |
| *H01R 107/00* | (2006.01) |

(52) U.S. Cl.

CPC ..... *H01R 13/6585* (2013.01); *H01R 12/724* (2013.01); *H01R 24/50* (2013.01); *H01R 24/62* (2013.01); *H01R 2103/00* (2013.01); *H01R 2107/00* (2013.01)

(58) Field of Classification Search

CPC ..... H01R 12/7076; H01R 13/648

USPC ..... 439/78, 607.24, 607.25, 540.1

See application file for complete search history.

(56) References Cited

U.S. PATENT DOCUMENTS

| | | | | |
|---|---|---|---|---|
| 5,812,660 | A * | 9/1998 | Suzuki | H01R 13/516 379/438 |
| 6,093,057 | A * | 7/2000 | Lok | H01R 13/6275 439/353 |
| 6,383,024 | B1 * | 5/2002 | Wang | H01R 24/62 439/607.23 |
| 6,716,064 | B2 * | 4/2004 | Kubo | H01R 12/7047 439/541.5 |
| 6,764,339 | B2 * | 7/2004 | Kubo | H01R 23/6873 439/607.24 |
| 6,875,055 | B2 * | 4/2005 | Chu | H01R 23/6873 439/607.24 |

(Continued)

*Primary Examiner* — Abdullah Riyami
*Assistant Examiner* — Nader Alhawamdeh
(74) *Attorney, Agent, or Firm* — Locke Lord LLP; Tim Tingkang Xia, Esq.

(57) ABSTRACT

An electrical connector assembly for electrically connecting to a chip module, includes a first metal casing having a first accommodating cavity, a first electrical connecting base received in the first accommodating cavity, a second metal casing having a second accommodating cavity, and a second electrical connecting base received in the second accommodating cavity. The second metal casing includes a fixing portion fixed to an outer surface of the first metal casing, and the second metal casing is fixed onto a circuit board. The first and second electrical connecting bases mate with first and second mating plugs. The first and second mating plugs are configured to transmit signals of different specifications. It is convenient to separate or combine the first electrical connecting base and the second connecting base.

18 Claims, 13 Drawing Sheets

(56) References Cited

U.S. PATENT DOCUMENTS

| | | | | |
|---|---|---|---|---|
| 6,932,646 | B2 * | 8/2005 | Sloey | H01R 13/6581 439/607.4 |
| 7,510,406 | B2 * | 3/2009 | Dong | H01R 12/7011 439/79 |
| 8,303,344 | B2 * | 11/2012 | Xiao | H01R 27/02 439/607.24 |
| 9,281,642 | B1 * | 3/2016 | Tseng | H01R 24/60 |
| 2015/0171574 | A1 * | 6/2015 | Little | H01R 24/60 439/78 |
| 2015/0229077 | A1 * | 8/2015 | Little | H01R 13/6582 439/78 |
| 2015/0255905 | A1 * | 9/2015 | Little | H01R 13/6658 439/78 |
| 2016/0118750 | A1 * | 4/2016 | Guo | H01R 13/6585 439/78 |

* cited by examiner

ELECTRICAL CONNECTOR ASSEMBLY

CROSS-REFERENCE TO RELATED APPLICATION

This non-provisional application claims priority under 35 U.S.C. §119(a) on Patent Application No. 201520125120.4 filed in P.R. China on Mar. 4, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector assembly, and more particularly to an electrical connector assembly used for transmitting signals of different specifications.

BACKGROUND OF THE INVENTION

Chinese patent No. CN201220545966.X discloses a module connector. The module connector includes a data signal electrical connector, a first radio frequency signal electrical connector and a second radio frequency signal electrical connector which are separately and individually manufactured and molded, and a shielding casing made of a metal material. The shielding casing surrounds outer surfaces of the data signal electrical connector, the first radio frequency signal electrical connector and the second radio frequency signal electrical connector. The shielding casing includes an upper shielding casing and a lower shielding casing. The upper shielding casing and the lower shielding casing jointly cooperate to define multiple accommodating cavities accommodating the data signal electrical connector and the first and second radio frequency signal electrical connectors.

However, electrical connectors of different specifications are accommodated in the same shielding casing, thus it is not convenient to separate or combine the electrical connectors of the different specifications to be used individually or in combination.

Therefore, a heretofore unaddressed need exists in the art to address the aforementioned deficiencies and inadequacies.

SUMMARY OF THE INVENTION

In one aspect, the present invention is directed to an electrical connector assembly that can be conveniently separated and assembled.

In one embodiment, an electrical connector assembly includes a first metal casing having a first accommodating cavity, a first electrical connecting base received in the first accommodating cavity, a second metal casing having a second accommodating cavity, and a second electrical connecting base received in the second accommodating cavity. The second metal casing has a fixing portion fixed to an outer surface of the first metal casing, and the second metal casing is fixed onto a circuit board. The first electrical connecting base is used for mating a first mating plug, and the second electrical connecting base is used for mating a second mating plug. The first mating plug and the second mating plug are configured to transmit signals of different specifications.

In one embodiment, the second accommodating cavity is located at a side of the first metal casing, the first metal casing wraps the periphery of the first electrical connecting base, and the second metal casing wraps the periphery of the second electrical connecting base.

In one embodiment, an extending portion extends from the fixing portion to define the second accommodating cavity, and the head and the tail of the extending portion are connected by means of laser soldering to form the second accommodating cavity.

In one embodiment, a stopping wall extends downward from the fixing portion to be stopped at the back of the first metal casing.

In one embodiment, the stopping wall is provided with a grounding portion extending downward and being soldered to the circuit board.

In one embodiment, the second metal casing is provided with a stopping portion stopped at the back of the second electrical connecting base.

In one embodiment, a top surface of the second metal casing is provided with an elastic sheet entering the second accommodating cavity downward and used for urging the second mating plug downward.

In one embodiment, the first electrical connecting base includes a first insulating body, multiple first terminals and multiple second terminals, an upper grounding sheet, a lower grounding sheet, and a middle shielding sheet. The first insulating body has a first base and a first tongue extending forward from the first base. The multiple first terminals and the multiple second terminals are respectively arranged into an upper row and a lower row and are embedded in the first insulating body. Each of the first terminals has a first contact portion exposed from an upper surface of the first tongue, and each of the second terminals has a second contact portion exposed from a lower surface of the first tongue. The upper grounding sheet is located above the first terminals. The lower grounding sheet is located below the second terminals and associated with the upper grounding sheet. The middle shielding sheet is located between the first terminals and the second terminals.

In one embodiment, the first mating plug includes a holding sheet contacting the middle shielding sheet, and the holding sheet is provided with an insertion portion extending downward and being inserted into the circuit board.

In one embodiment, the holding sheet is provided with a notch running through a lower edge of the holding sheet, and the holding sheet holds the first mating plug using the notch.

In one embodiment, the second electrical connecting base is of a specification for transmitting a radio frequency signal.

In one embodiment, the second metal casing wraps a top surface and two sides of the first metal casing, the fixing portion is fixed to the top surface of the first metal casing by means of laser soldering, and two buckling sheets extend downward respectively from two side edges of the fixing portion to buckle the two sides of the first metal casing.

In one embodiment, the first metal casing is provided with a rear wall stopped at the back of the first electrical connecting base, the first electrical connecting base is provided with a boss, and the rear wall is provided with a supporting leg extending downward and supported on the boss.

In one embodiment, the first mating plug has a third metal casing, the third metal casing has a fixing frame fixed to the circuit board and a mating frame extending forward from the fixing frame and entering the first accommodating cavity, an insulating sleeve is only sleeved over the mating frame, the insulating sleeve is provided with a limiting portion stopped at a front end of the mating frame, and the insulating sleeve is supported on the circuit board.

In one embodiment, the first mating plug includes an insulating block and a terminal group insert-molded in the insulating block, the terminal group has a soldering portion, the insulating block is provided with an isolation portion between two adjacent soldering portions, the insulating block is provided, at a side of the soldering portion, with a slot extending to the soldering portion, and a top surface of the slot is higher than a bottom surface of the isolation portion.

In one embodiment, the first mating plug includes a body, and an upper row of terminals and a lower row of terminals located in the body. Each of the upper row of terminals and the lower row of terminals has a conducting portion electrically connected to the first electrical connecting base. An upper shielding sheet is located above the body, and a lower shielding sheet is located below the body. The upper shielding sheet or the lower shielding sheet is provided with a main portion and a side portion bending and extending from each of two sides of the main portion. The main portion is provided with an opening corresponding to the conducting portion and passing through to the side portion.

Compared with the related art, certain embodiments of the present invention have the following beneficial advantages.

The first metal casing is provided with a first accommodating cavity accommodating the first electrical connecting base, the second metal casing is provided with a fixing portion fixed to the outer surface of the first metal casing, and the second metal casing is provided with a second accommodating cavity accommodating the second electrical connecting base, so that it is convenient to separate or combine the first electrical connecting base and the second connecting base.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
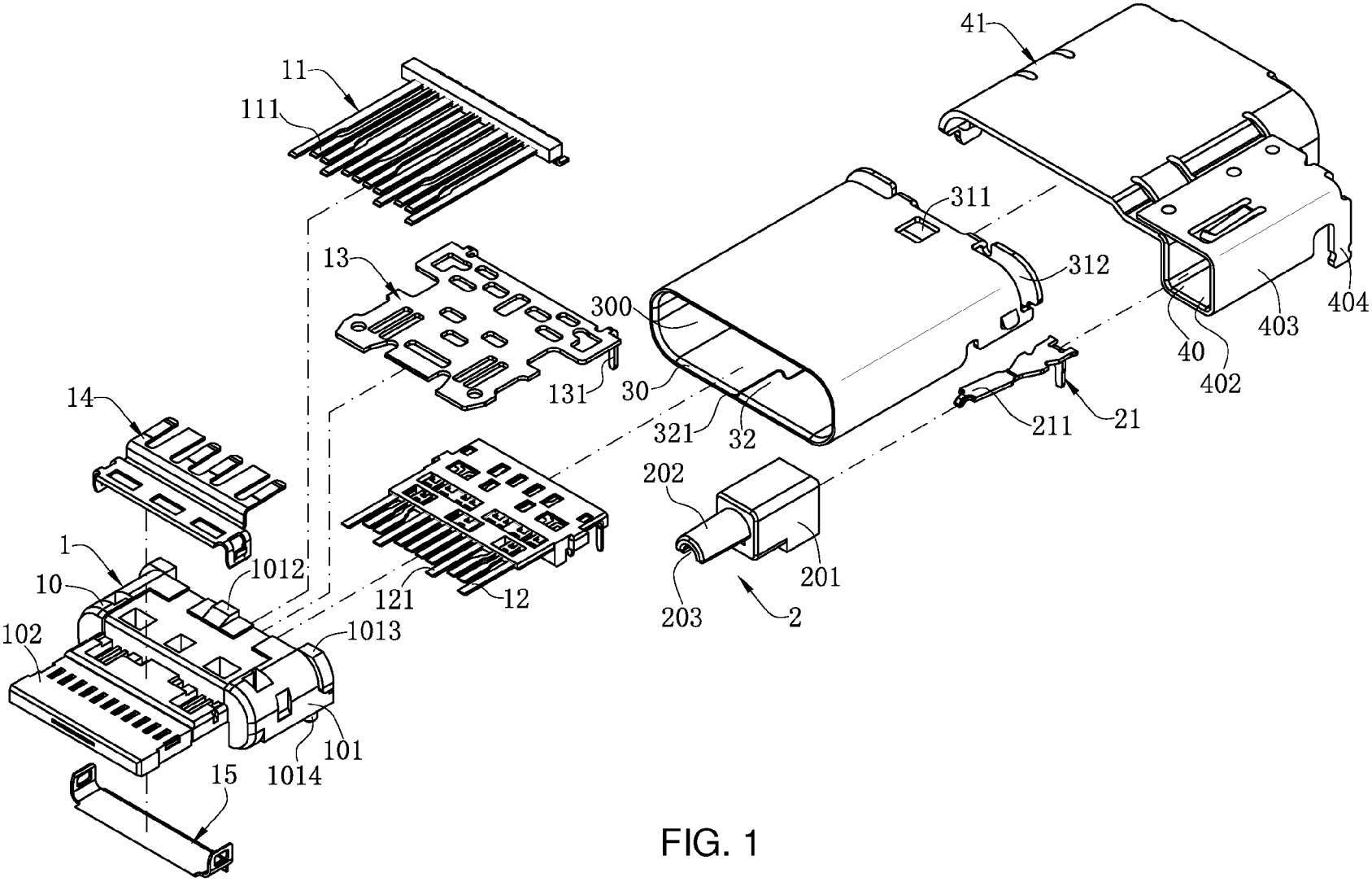
FIG. 1 is a schematic three-dimensional exploded view of an electrical connector assembly according to one embodiment of the present invention.
Figure 2:
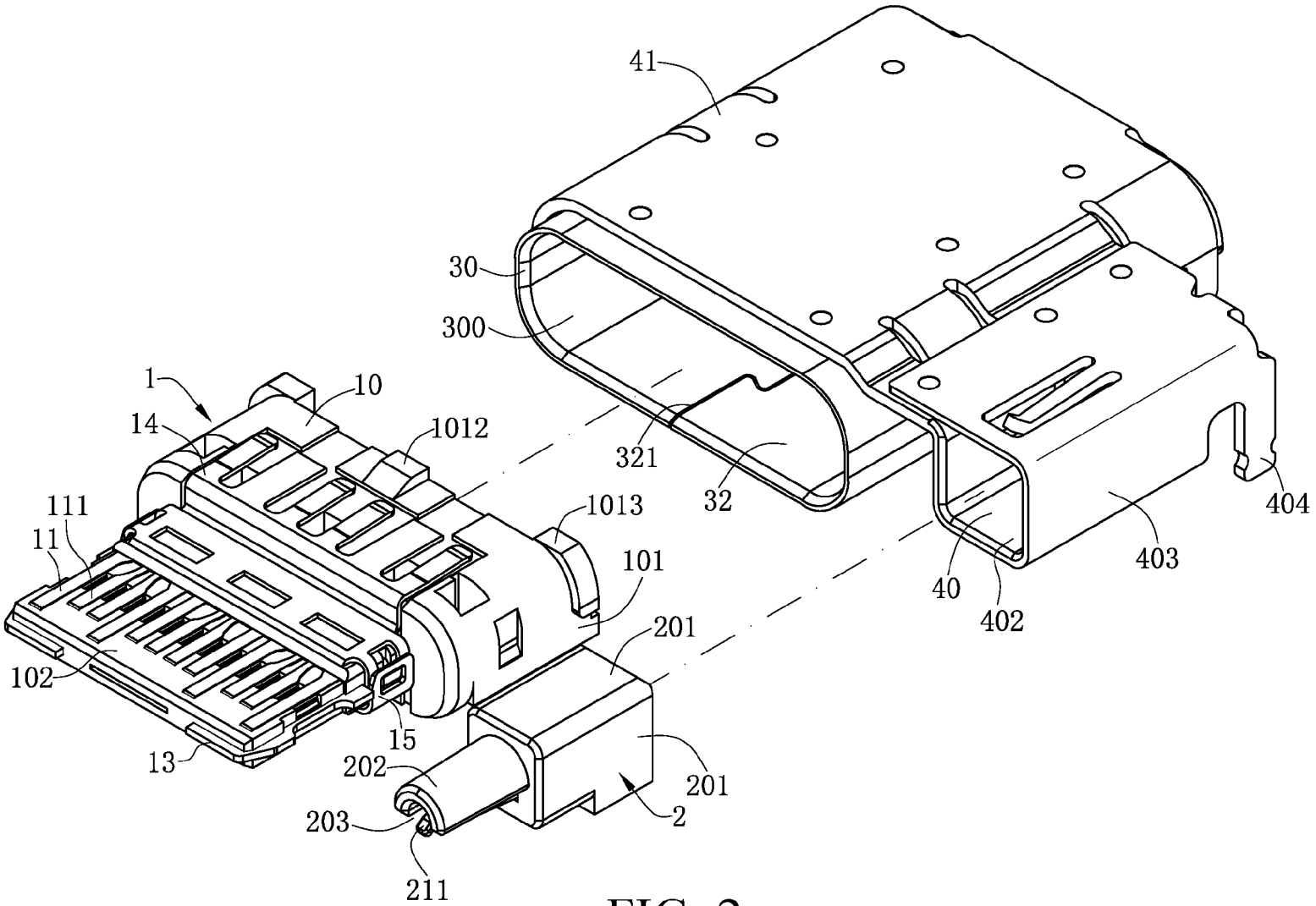
FIG. 2 is a schematic three-dimensional exploded view of partial assembly of the electrical connector assembly according to one embodiment of the present invention.
Figure 3:
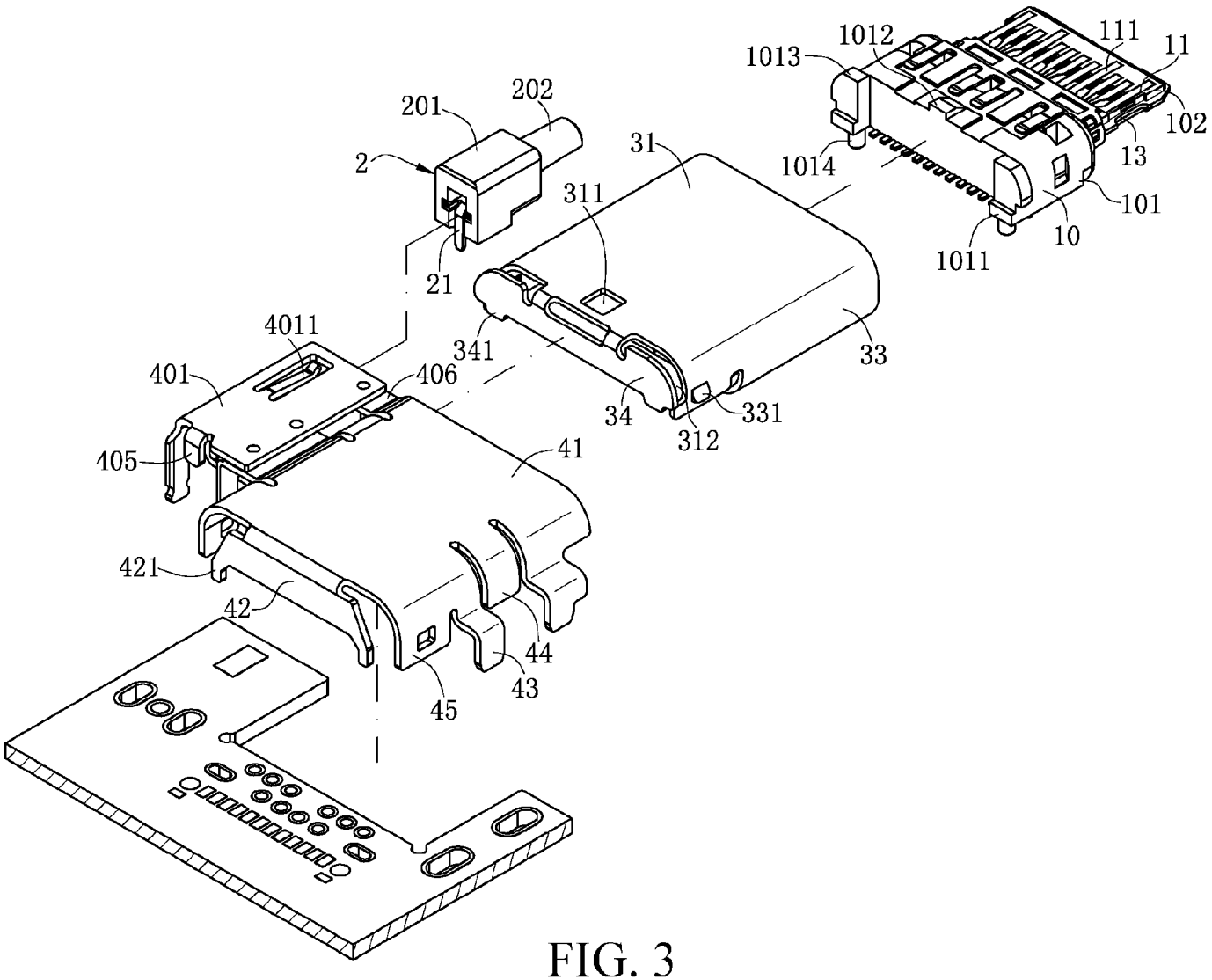
FIG. 3 is another schematic three-dimensional exploded view of the electrical connector assembly according to one embodiment of the present invention.
Figure 4:
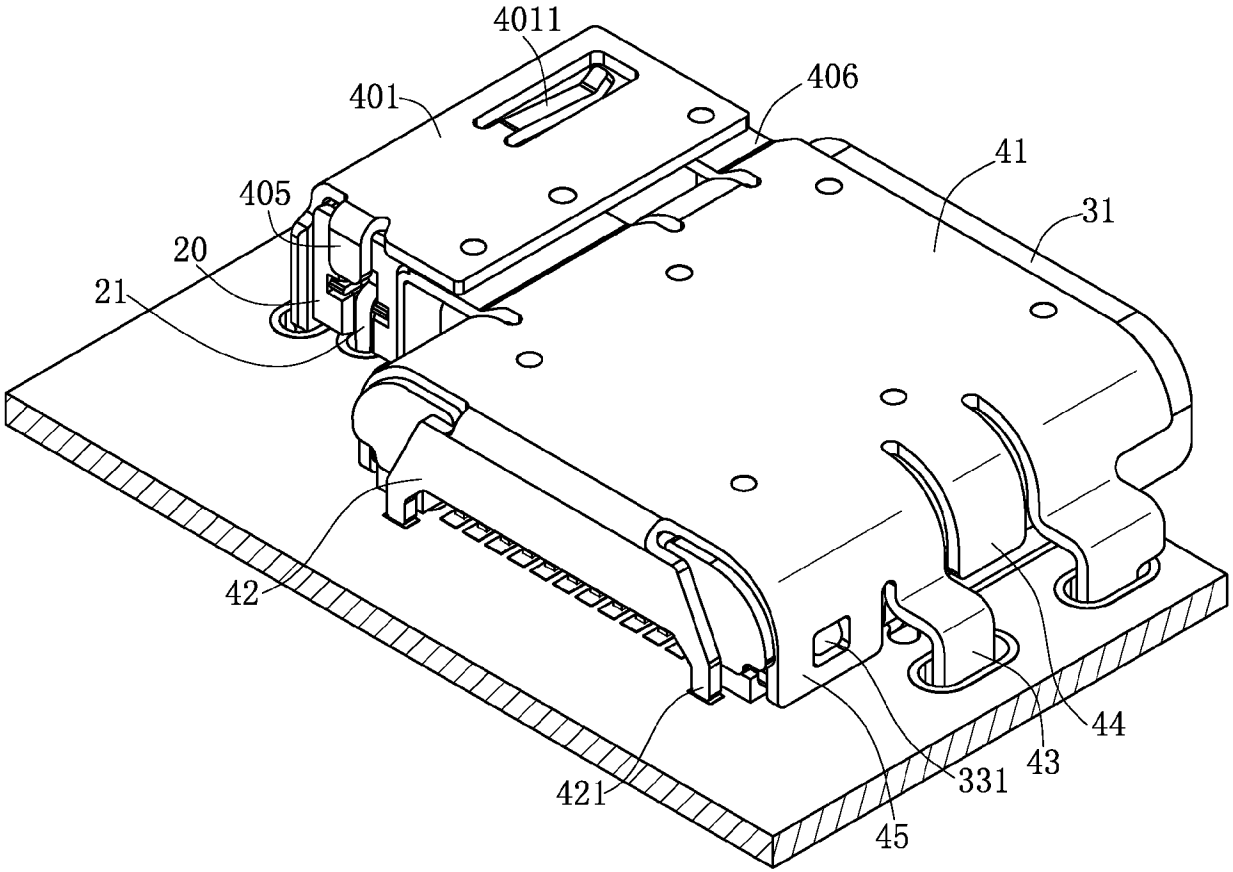
FIG. 4 is a schematic assembly drawing of the electrical connector assembly according to one embodiment of the present invention.
Figure 5:
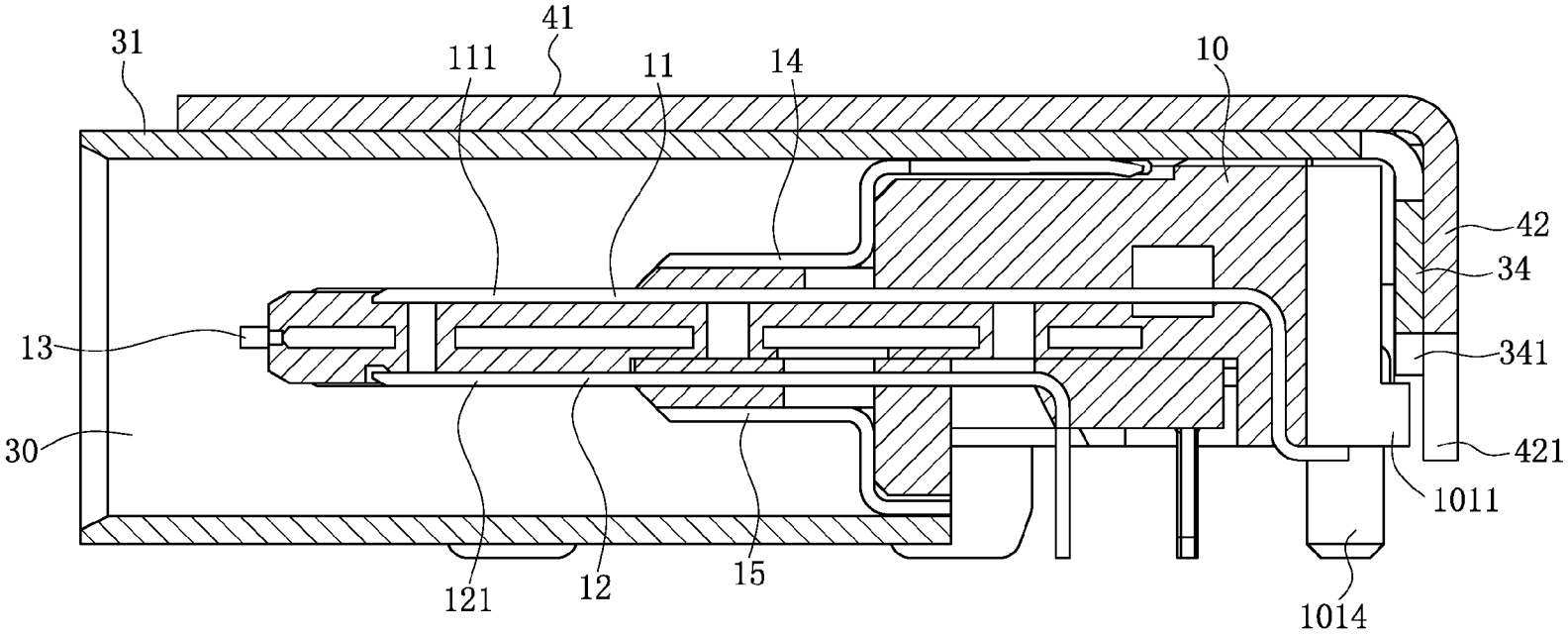
FIG. 5 is a sectional view of FIG. 4.
Figure 6:
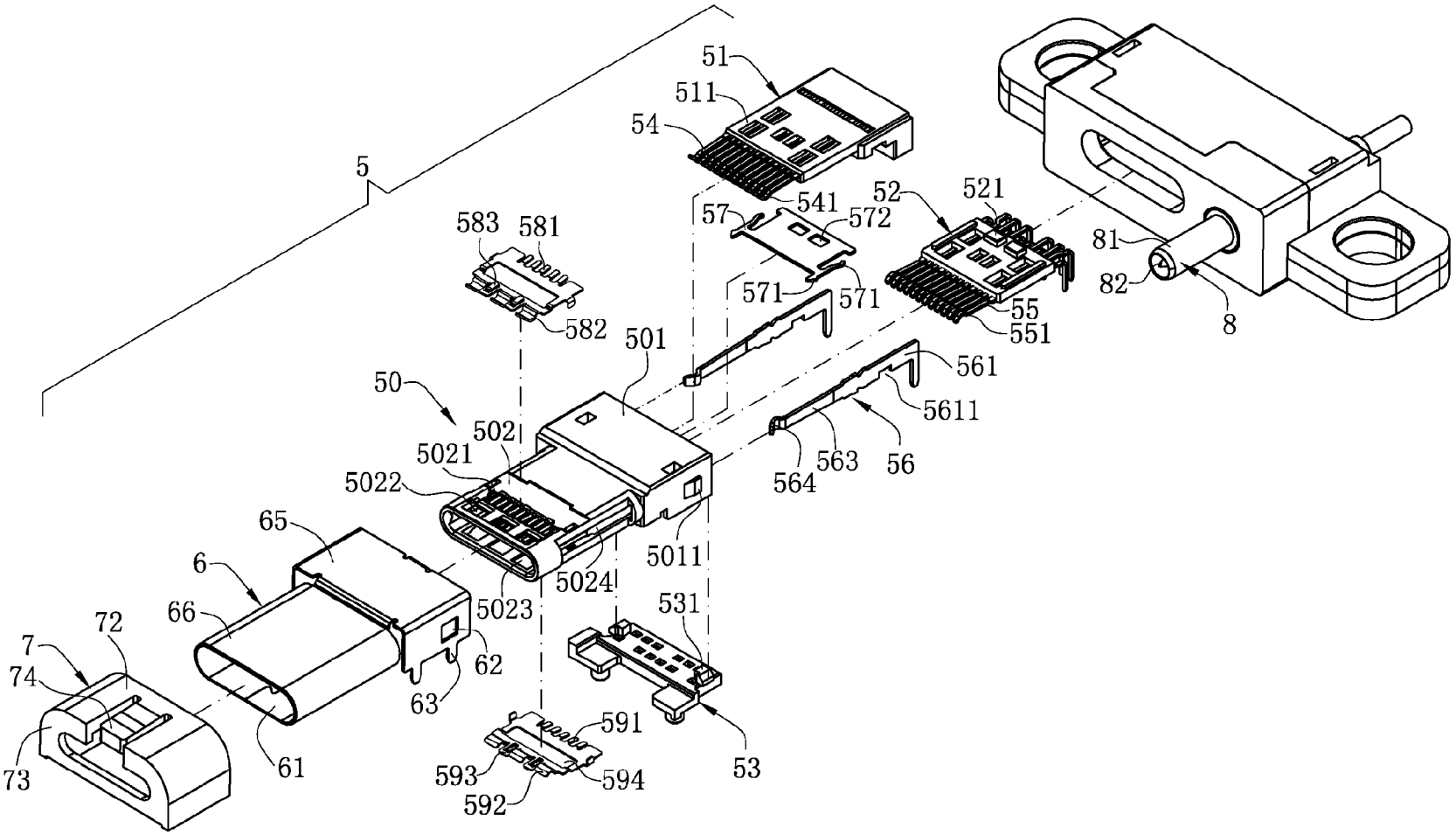
FIG. 6 is a schematic three-dimensional exploded view of a mating connector according to one embodiment of the present invention.
Figure 7:
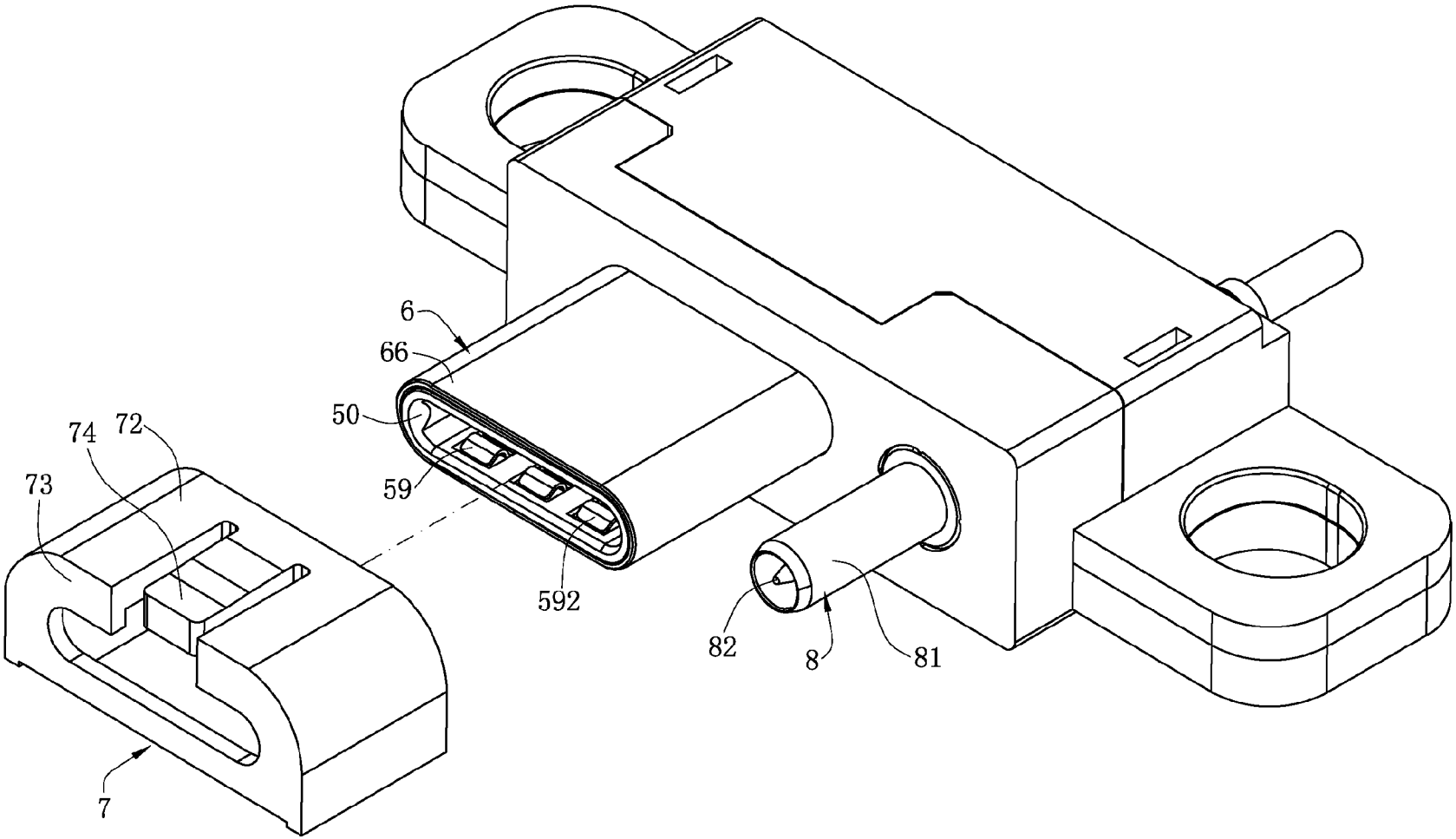
FIG. 7 is a schematic three-dimensional exploded view of partial assembly of the mating connector according to one embodiment of the present invention.
Figure 8:
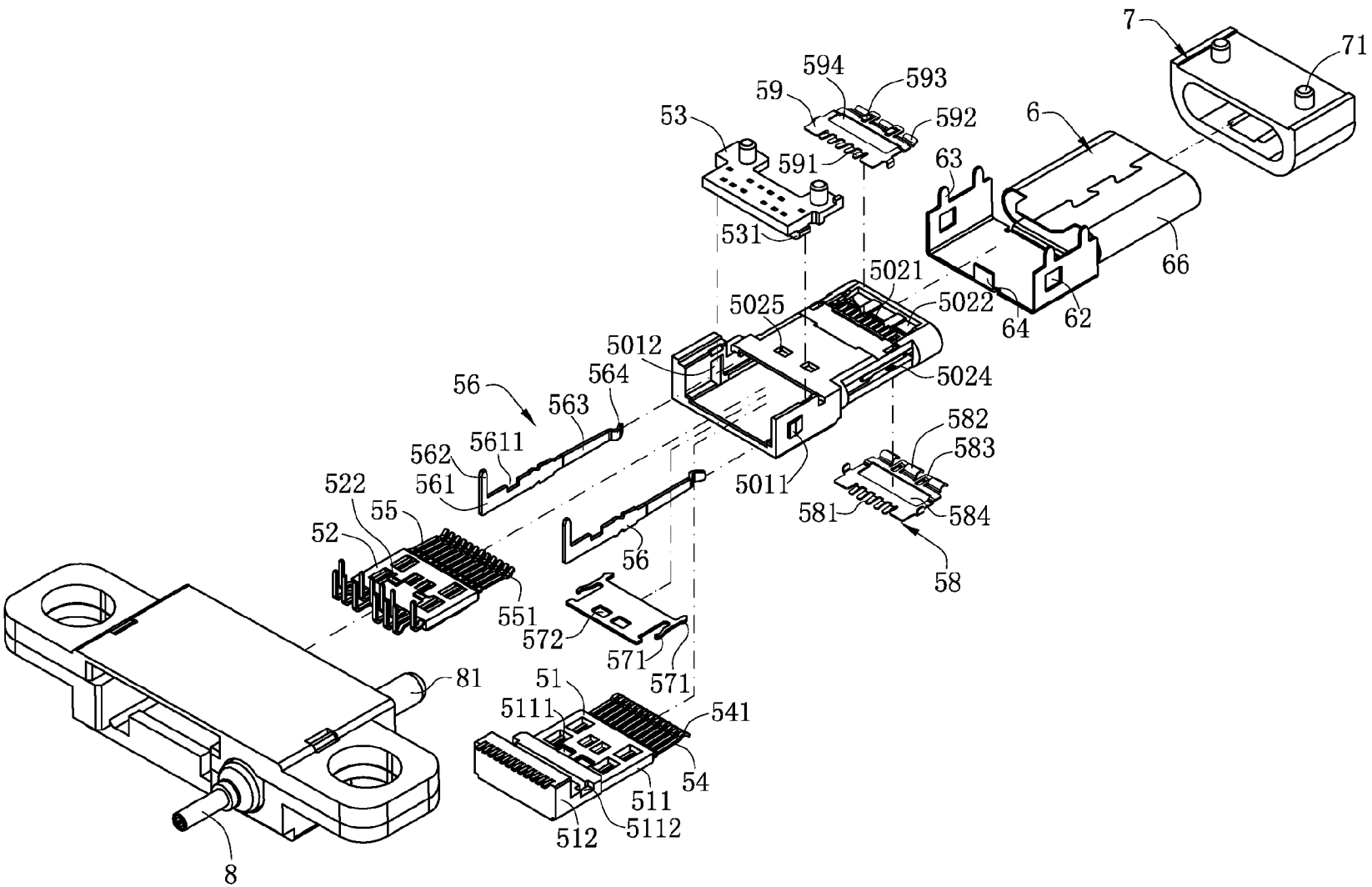
FIG. 8 is another schematic three-dimensional exploded view of the mating connector according to one embodiment of the present invention.
Figure 9:
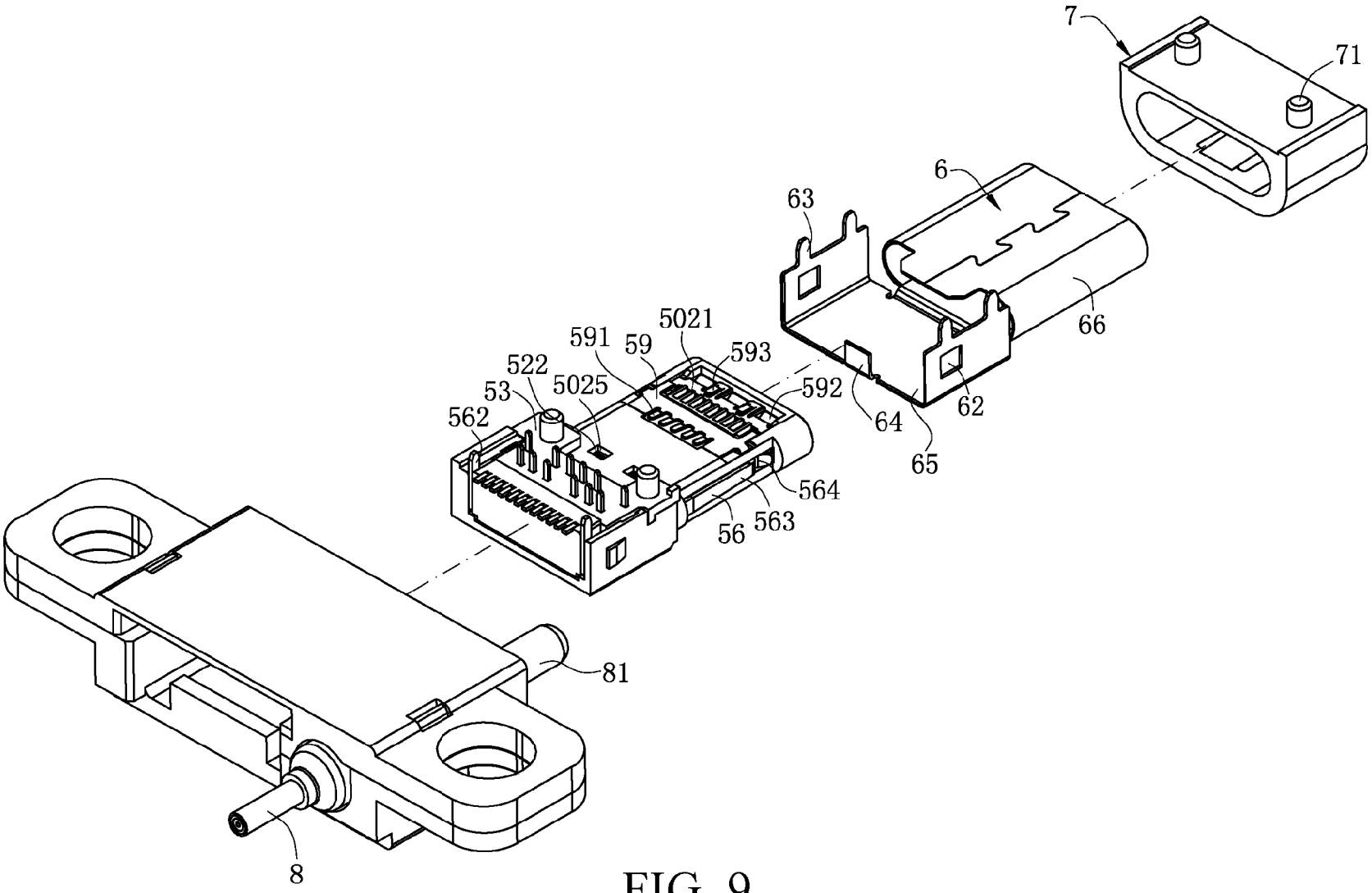
FIG. 9 is a schematic third three-dimensional exploded view of the mating connector according to one embodiment of the present invention.
Figure 10:
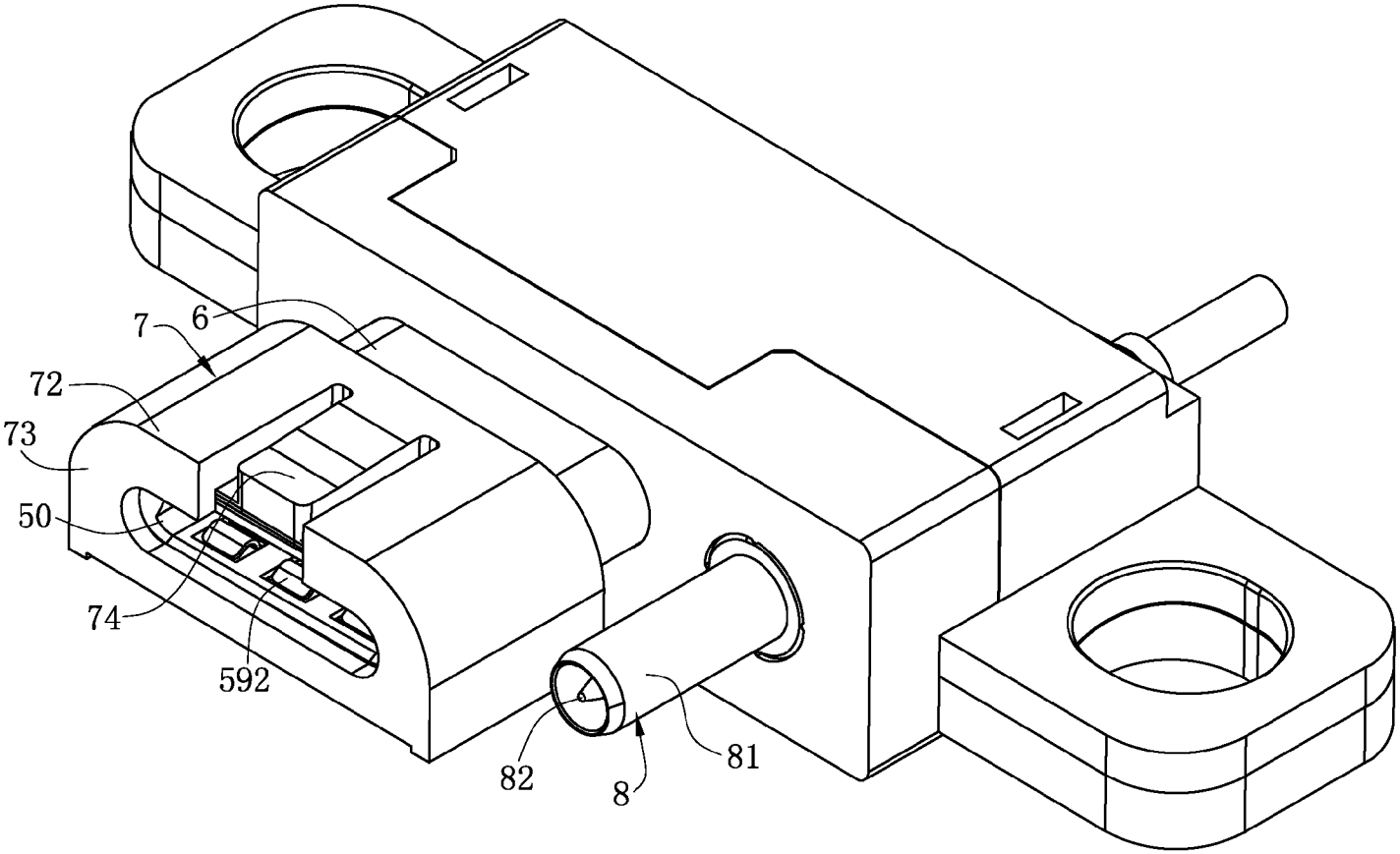
FIG. 10 is a schematic assembly drawing of the mating connector according to one embodiment of the present invention.
Figure 11:
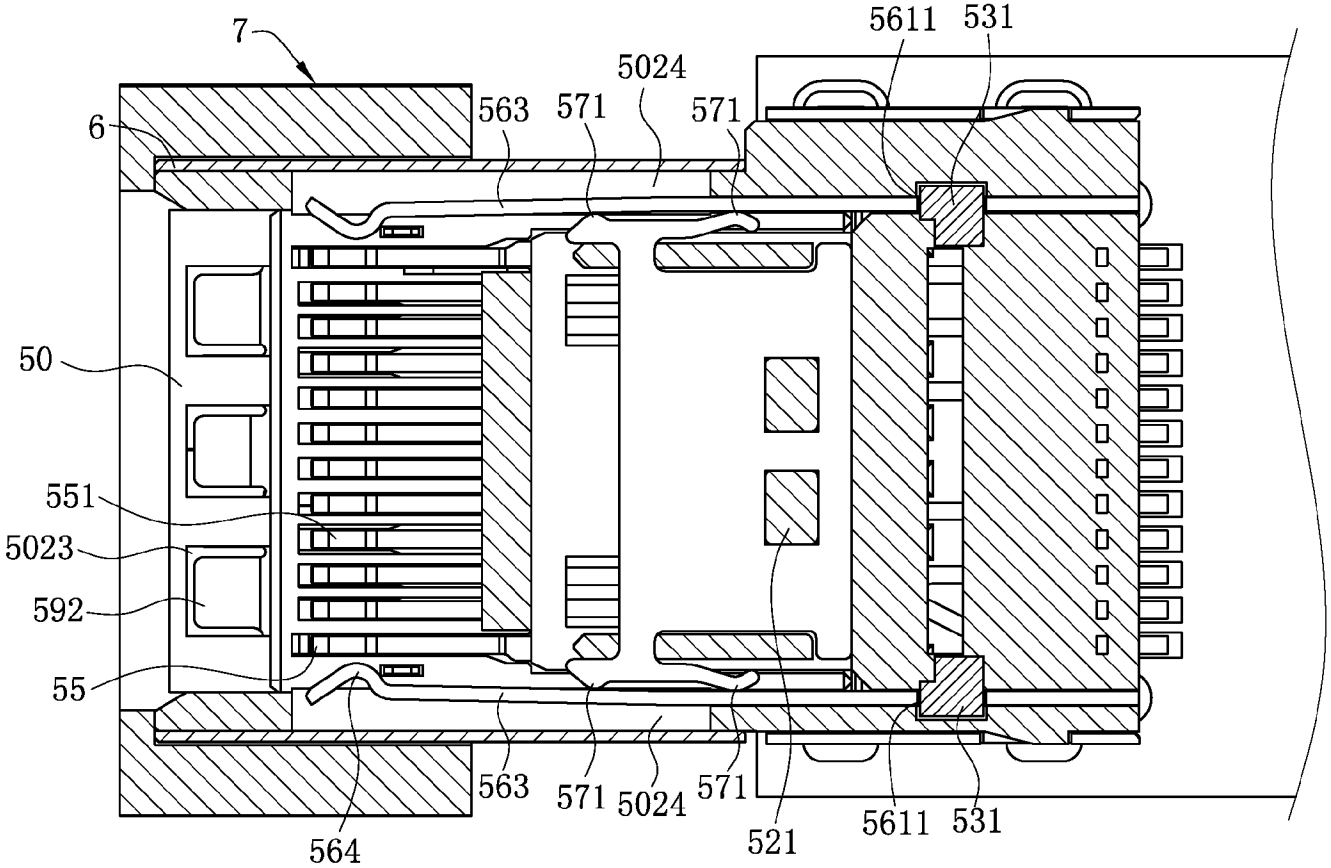
FIG. 11 is a sectional view of FIG. 10.
Figure 12:
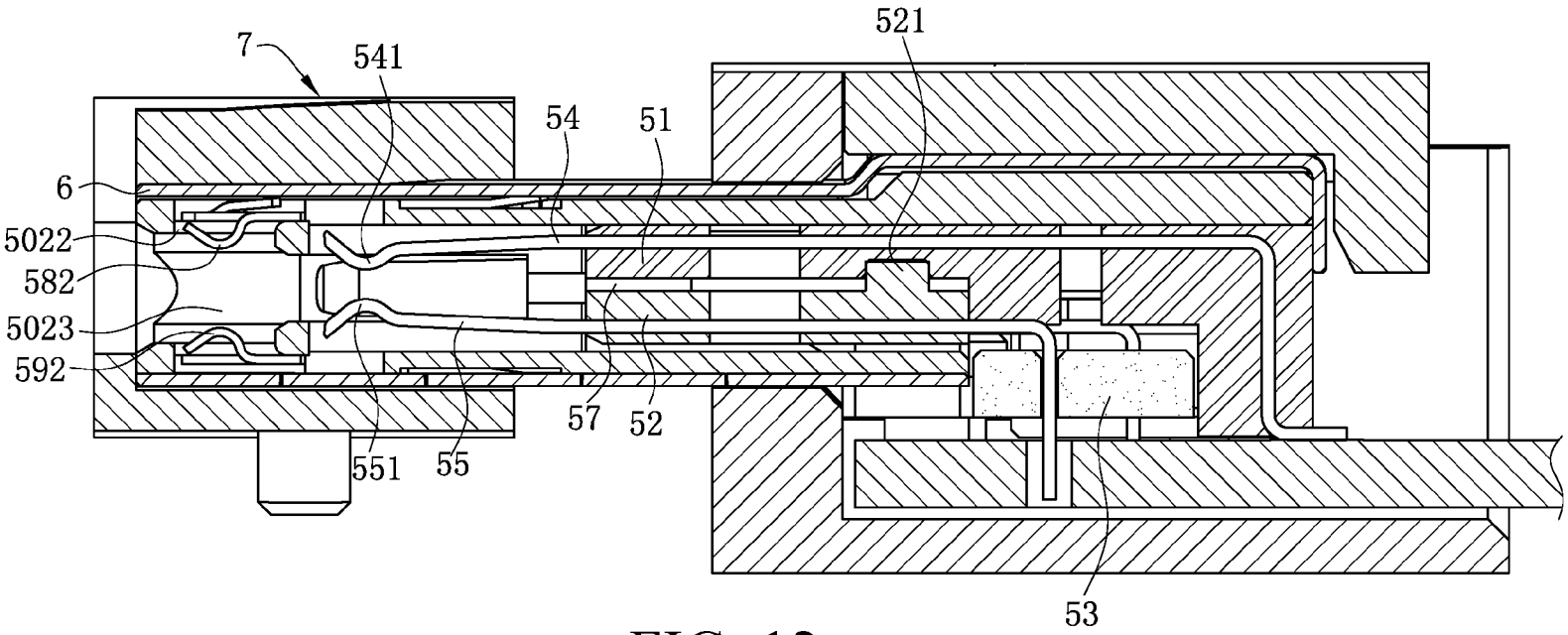
FIG. 12 is another sectional view of FIG. 10.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to. The description will be made as to the embodiments of the present invention in conjunction with the accompanying drawings in FIGS. 1-13. In accordance with the purposes of this invention, as embodied and broadly described herein, this invention, in one aspect, relates to an electrical connector.

As shown in FIG. 1 to FIG. 12, a first embodiment of an electrical connector assembly of the present invention includes a first electrical connecting base 1, a second electrical connecting base 2, a first metal casing 3 and a second metal casing 4. The first electrical connecting base 1 has a specification of transmitting a USB type C signal. The second electrical connecting base 2 has a specification of transmitting a radio frequency signal. The first metal casing 3 has a first accommodating cavity 300 for accommodating the first electrical connecting base 1. The second metal casing 4 is fixed to an outer surface of the first metal casing 3. The second metal casing 4 bends to form a second accommodating cavity 40 (in other embodiments, the second metal casing 4 is not merely limited to bending to form a second accommodating cavity 40) for accommodating the second electrical connecting base 2. The second metal casing 4 is fixed to a circuit board. The electrical connector assembly and a mating connector are mated. The mating connector includes a first mating plug 5 mating the first electrical connecting base 1 and a second mating plug 8 mating the second electrical connecting base 2.

As shown in FIG. 1 to FIG. 5, the first electrical connecting base 1 includes a first insulating body 10, multiple first terminals 11 and multiple second terminals 12. The first insulating body 10 has a first base 101 and a first tongue 102 extending forward from the first base 101. The rear side of the first base 101 is provided with two bosses 1011. The top surface of the first base 101 is provided with a first protruding block 1012 protruding upward and two second protruding blocks 1013. Two round posts 1014 are protruded downward from the bottom surface of the first base 101, and are used for fixing the first electrical connecting base 1 onto the circuit board. The multiple first terminals 11 and the multiple second terminals 12 are arranged into an upper row and a lower row embedded in the first insulating body 10. Each of the number of the first terminals 11 and the number of the second terminals 12 is twelve, and each of the first terminals 11 and the second terminals 12 includes two pairs of high-speed differential signal terminals. Each of the first terminals 11 has a first contact portion 111 exposed from the upper surface of the first tongue 102, and each of the second terminals 12 has a second contact portion 121 exposed from the lower surface of the first tongue 102.

As shown in FIG. 1 to FIG. 5, a first middle shielding sheet 13 is inserted in the first insulating body 10. The first middle shielding sheet 13 is located between the first terminals 11 and the second terminals 12, to shield an interference signal between the first terminals 11 and the second terminals 12. The first middle shielding sheet 13 has two first insertion portions 131 bending and extending downward. The first insertion portions 131 are soldered to the circuit board, and the first insertion portions 131 are located at the rear side of the first insulating body 10. The first electrical connecting base 1 further includes an upper grounding sheet 14 and a lower grounding sheet 15 snap-fit with each other. The upper grounding sheet 14 is located above the first terminals 11, and used for shielding an interference signal above the first terminals 11. The upper grounding sheet 14 and the first metal casing 3 contact each other. The lower grounding sheet 15 is located below the second terminals 12, and used for shielding an interference signal below the second terminals 12. The lower grounding sheet 15 and the first metal casing 3 contact each other.

As shown in FIG. 1 to FIG. 5, the second electrical connecting base 2 includes a second insulating body 20 and a third terminal 21 disposed in the second insulating body 20. The second insulating body 20 includes a second base portion 201. The second base portion 201 is in a shape of square. A semi-cylindrical mating portion 202 extends forward from the second base portion 201, and the mating portion 202 extends forward and is roughly flush with the front surface of the first tongue 102. The second insulating body 20 is provided with an insertion hole 203 running through the second insulating body 20. The third terminal 21 is mounted in the insertion hole 203. The third terminal 21 has a third contact portion 211 electrically contacting a second mating plug 8.

As shown in FIG. 1 to FIG. 5, the first metal casing 3 wraps the periphery of the first electrical connecting base 1. The front end of the first metal casing 3 has a first mating opening 30 which is elliptic. The first mating opening 30 is used for insertion of a first mating plug 5 in dual orientations. The first metal casing 3 includes a first top wall 31, a first bottom wall 32, two first side walls 33 connecting the first top wall 31 and the first bottom wall 32, and a rear wall 34 bending and extending downward from the back end of the first top wall 31 and used for stopping the first electrical connecting base 1. Two ends of the rear wall 34 are provided with two supporting legs 341 extending downward (in other embodiments, the supporting leg 341 may be one or more in number) and supported on the bosses 1011. The first top wall 31, the first bottom wall 32, and the two first side walls 33 define a peripherally closed space to accommodate the first electrical connecting base 1. The first bottom wall 32 has a first seam 321. The first top wall 31 is provided with a first engagement hole 311 for engaging with the first protruding block 1012. Two engagement slots 312 are formed between the rear wall 34 and the first top wall 31, and used for engaging with the two second protruding blocks 1013. The first engagement hole 311 and the engagement slot 312 correspondingly are engaged with the first protruding block 1012 and the second protruding block 1013 and are used for fixing the first metal casing 3 and the first electrical connecting base 1. Each of the first side walls 33 is provided with a first protruding portion 331 protruding outward (in other embodiments, the first protruding portions 331 may also be disposed at other positions of the first metal casing 3, and the number of the first protruding portions 331 is not merely limited to two), and used for buckling the second metal casing 4.

As shown in FIG. 1 to FIG. 5, the second metal casing 4 wraps a top surface and two sides of the first metal casing 3. The second metal casing 4 wraps the periphery of the second electrical connecting base 2. The second metal casing 4 has a fixing portion 41, and the fixing portion 41 is fixed to the first top wall 31 by means of laser soldering (the fixing portion is not merely limited to being soldered to the first top wall 31 by means of laser). A stopping wall 42 bends and extends downward from the back end of the fixing portion 41, for stopping the first metal casing 3. The stopping wall 42 includes two grounding portions 421 extending downward (in other embodiments, the number of the grounding portions 421 is not merely limited to two, and may be one or more) and soldered to the circuit board. Two first pins 43 bends and extends downward from a side of the fixing portion 41. A first stopping portion 44 extends downward between the two first pins 43 and is used for stopping the first metal casing 3. The first pin 43 is soldered to the circuit board. One such first stopping portion 44 also bends downward from another side of the fixing portion 41. Moreover, the second metal casing 4 has two buckling sheets 45 corresponding to the first protruding portions 331. The buckling sheets 45 extend downward from two sides of the fixing portion 41. The first protruding portions 331 buckle the buckling sheets 45 and fixing the first metal casing 3 to the second metal casing 4. The buckling sheets 45 are located behind the two first pins 43.

As shown in FIG. 1 to FIG. 5, an extending portion (not labeled) extends from another side of the fixing portion 41. The extending portion includes a connection portion 406. One of the second side walls 403 extends vertically and downward from an end of the connection portion 406. The second bottom wall 402 extends horizontally from an end of the second side wall 403 in a direction away from the first metal casing 3. The other of the second side walls 403 extends vertically and upward from an end of the second bottom wall 402. The second top wall 401 extends horizontally from an end of the second side wall 403 in a direction toward the first metal casing 3, and a part of the second top wall 401 and a part of the connection portion 406 are overlapped and used for laser soldering. The second top wall 401, the second bottom wall 402, and the two second side walls 403 connecting the second top wall 401 and the second bottom wall 402 define the second accommodating cavity 40 accommodating the second electrical connecting base 2. The second accommodating cavity 40 and the first metal casing 3 are disposed abreast (in other embodiments, the second accommodating cavity 40 and the first metal casing 3 are not merely limited to being disposed abreast, and the second accommodating cavity 40 is not merely limited to one in number). The second top wall 401 is provided with an elastic sheet 4011 entering the second accommodating cavity 40 downward and used for urging a second mating plug 8 downward. A second stopping portion 405 bends downward from the back end of the second top wall 401 and is used for stopping the second electrical connecting base 2. The back end of each of the second side walls 403 is provided with a second pin 404, and the second pin 404 is soldered to the circuit board.

As shown in FIG. 6 to FIG. 12, the first electrical connecting base 1 and a first mating plug 5 are mated. The first mating plug 5 has a first body 50. A third metal casing 6 wraps the first body 50. An upper insulating block 51, a lower insulating block 52 and a fixing base 53 are accommodated in the first body 50. An upper row terminal group 54 is embedded into the upper insulating block 51, and a lower row terminal group 55 is embedded into the lower insulating block 52. The upper row terminal group 54 and the lower row terminal group 55 are the same in structure. The upper row terminal group 54 and the lower row terminal group 55 have conducting portions 541 and conducting portions 551 respectively, which are used for contacting corresponding first contact portions 111 and second contact portions 121.

As shown in FIG. 6 to FIG. 12, the first body 50 includes a main body portion 501, and a frame body 502 extending forward from the main body portion 501. The height of the main body portion 501 in the vertical direction is greater than the height of the frame body 502. Each of two sides of the main body portion 501 is provided with a second protruding portion 5011, and the second protruding portions 5011 are used for fixing the first body 50 and the third metal casing 6. The frame body 502 is provided with multiple terminal slots 5021 running through the upper wall and the lower wall of the frame body 502 and corresponding to the conducting portions 541 and 551 of the upper row terminal group 54 and the lower row terminal group 55. The frame body 502 is further provided with several through-slots 5022 in front of the terminal slots 5021. The front end of the frame body 502 is provided with a mating space 5023 used for accommodating the first electrical connecting base 1. The mating space 5023 and the terminal slot 5021 are in communication with each other. A hollowing portion 5024 is depressed from each of two opposite sides of the frame body 502. The upper insulating block 51 includes a flat plate portion 511 and a support base 512 protruding downward from the flat plate portion 511. Two first grooves 5111 are depressed from the bottom surface of the flat plate portion 511. Two first engagement blocks 521 protrude from the top surface of the lower insulating block 52. The first engagement blocks 521 and the first grooves 5111 are engaged, so as to combine and fix the upper insulating block 51 and the lower insulating block 52. A back end of each of two side edges of the flat plate portion 511 is provided with a second groove 5112. Two second engagement blocks 531 protrude upward from the top surface of the fixing base 53. The second engagement block 531 is accommodated in the second groove 5112. Each inner side wall of the main body portion 501 is provided with a vertical holding slot 5012 corresponding to the second engagement block 531. The fixing base 53 is inserted from the lower portion of the main body portion 501, so that the second engagement blocks 531 are engaged with the holding slots 5012 to fix the fixing base 53 to the first body 50 (in other embodiments, the holding slots 5012 may also be disposed in a transverse direction, and the fixing base 53 is inserted from the back of the main body portion 501, so that the second engagement blocks 531 are engaged with the holding slots 5012 to fix the fixing base 53 to the first body 50). Two third engagement blocks 522 protrude downward from the bottom surface of the lower insulating block 52. The bottom surface of the frame body 502 is provided with two third grooves 5025. The third engagement blocks 522 and the third grooves 5025 are engaged, so as to combine and fix the lower insulating block 52 and the first body 50.

As shown in FIG. 6 to FIG. 12, the first mating plug 5 further includes two holding sheets 56 (in other embodiments, the holding sheet 56 may be one or more in number) held in the first body 50. Each of the holding sheets 56 includes a holding portion 561 fixed to the inner side of the main body portion 501. A second insertion portion 562 bends and extends downward from an end of the holding portion 561, and the second insertion portion 562 is soldered to the circuit board. The holding portion 561 is provided with a notch 5611, and each of the notches 5611 is engaged with one of the second engagement blocks 531, so as to fix the holding sheet 56 and the fixing base 53. A plate portion 563 extends forward from the holding portion 561, and the plate portion 563 is located at the hollowing portion 5024 of the frame body 502. An end of the plate portion 563 is provided with an elastic portion 564. The elastic portion 564 is a free end of the holding sheet 56, and is movably located at the hollowing portion 5024. The elastic portion 564 is located at the front end of the first body 50 to resist the first electrical connecting base 1, and is used for providing a stable insertion and removing force, so as to ensure that the first mating plug 5 and the first electrical connecting base 1 are mated firmly, and are not easily disengaged.

As shown in FIG. 6 to FIG. 12, the first mating plug 5 further includes a second middle shielding sheet 57, which is located between the upper row terminal group 54 and the lower row terminal group 55, and shields an interference signal between the upper row terminal group 54 and the lower row terminal group 55. Two urging portions 571 each bend and extend outward and then backward from the front end at one side of the second middle shielding sheet 57 (in other embodiments, the urging portion 571 may be one or more) and urge the plate portion 563. The urging portions 571 are elastic, and elastically urge the plate portion 563. The second middle shielding sheet 57 are provided with two mounting holes 572 corresponding to the first engagement blocks 521 of the lower insulating block 52. Each of the first engagement blocks 521 passes through the corresponding mounting hole 572 to engage with the first groove 5111 of the upper insulating block 51, and the second middle shielding sheet 57 is fixed between the upper insulating blocks 51 and the lower insulating blocks 52. Therefore the middle shielding sheet 57 is fixed simply, mounted easily, and fixed without the need of adding another fixing structure, and is simple in structure.

As shown in FIG. 6 to FIG. 12, the first mating plug 5 further includes an upper shielding sheet 58 and a lower shielding sheet 59. The upper shielding sheet 58 is fixed to the top surface of the frame body 502, and the lower shielding sheet 59 is fixed to the bottom surface of the frame body 502. Both the upper shielding sheet 58 and the lower shielding sheet 59 are located in the third metal casing 6, and contact the third metal casing 6. The upper shielding sheet 58 is located above the upper row terminal group 54, and used for shielding an interference signal above the upper row terminal group 54. The lower shielding sheet 59 is located below the lower row terminal group 55, and used for shielding an interference signal below the lower row terminal group 55. The upper shielding sheet 58 and the lower shielding sheet 59 are respectively provided with an opening 584 and an opening 594 corresponding to the terminal slot 5021. Five first elastic arms 581 and five first elastic arms 591 contacting the third metal casing 6 protrude backward from the back end of the upper shielding sheet 58 and the back end of the lower shielding sheet 59 respectively (in other embodiments, the first elastic arms 581 and 591 may be one or more in number) and are grounded. Three bending portions 582 and three bending portions 592 respectively bend from the front end of the upper shielding sheet 58 and the front end of the lower shielding sheet 59 toward the mating space 5023, and the bending portions 582 and 592 pass through the through-slots 5022 to contact the first electrical connecting base 1. A second elastic arm 583 or 593 is disposed between the bending portions 582 or 592 to contact the third metal casing 6 and is grounded.

As shown in FIG. 6 to FIG. 12, the third metal casing 6 includes a fixing frame 65 and a mating frame 66 extending forward from the fixing frame 65 and entering the first accommodating cavity 300. The mating frame 66 wraps the outer surface of the frame body 502, and the fixing frame 65 wraps a top surface and two side surfaces of the main body portion 501. The front end of the mating frame 66 has a second mating opening 61 which is elliptic, and the second mating opening 61 is used for insertion of the first electrical connecting base 1. The fixing frame 65 is provided with a second engagement hole 62 corresponding to each of the second protruding portions 5011. The second protruding portion 5011 is engaged with the corresponding second engagement hole 62, so as to fix the third metal casing 6 and the first body 50. Two third pins 63 extend downward from each of two sides of the fixing frame 65. The third pins 63 are soldered to the circuit board. A third stopping portion 64 bends downward from the back end of the top surface of the fixing frame 65 to stop the first mating plug 5.

As shown in FIG. 6 to FIG. 12, an insulating sleeve 7 is only sleeved over the mating frame 66 but not sleeved over the fixing frame 65. The insulating sleeve 7 is made of insulating plastic. Two protruding columns 71 supported on the circuit board protrude downward from the bottom surface of the insulating sleeve 7 (in other embodiments, the insulating sleeve 7 may also be supported on the circuit board in other manners, the protruding columns 71 are not merely limited to protruding downward, and the protruding columns 71 are not merely limited to two in number), and used for supporting the mating portion 202 during soldering, so that the first mating plug 5 keeps balanced. The insulating sleeve 7 has a wrapping portion 72 wrapping the peripheral wall of the mating frame 66. A limiting portion 73 extends vertically from the front end of the wrapping portion 72, and the limiting portion 73 is stopped at the front end of the mating frame 66. The top surface of the wrapping portion 72 is provided with a sheet 74, and the sheet 74 is in interference fit with the mating frame 66 and used for clamping the third metal casing 6.

As shown in FIG. 6 to FIG. 12, the second electrical connecting base 2 and a second mating plug 8 are mated. The second mating plug 8 includes a second body 81 and a cylindrical terminal 82 disposed in the second body 81. The second body 81 is cylindrical.

Figure 13:
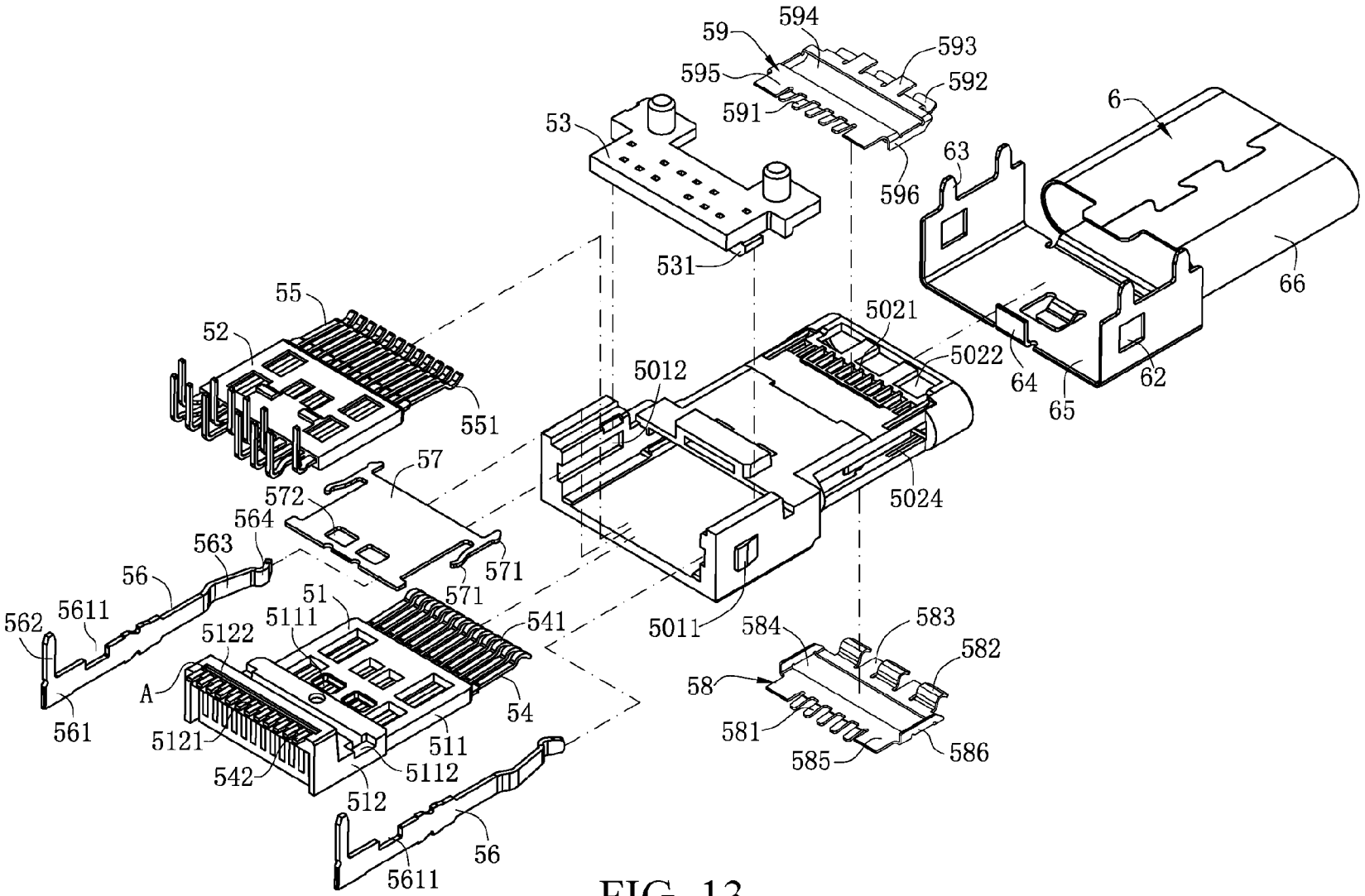
FIG. 13 is a schematic three-dimensional exploded view of a second embodiment of the mating connector according to the present invention.

Referring to FIG. 13, a second embodiment of an electrical connector assembly of the present invention is shown, and is different from the first embodiment as follows:

1. The bottom surface of the support base 512 of the upper insulating block 51 is provided with a slot 5122 at a side of the soldering portion 542. The upper insulating block 52 is provided with an isolation portion 5121 between adjacent two soldering portions 542. The top surface A of the slot 5122 is higher than the bottom surface of the isolation portion 5121, and the slot 5122 may prevent deckle edges and barbs generated at positions at which the upper row terminal group 54 contacts the bottom of the support base 512 from being higher than the soldering portion 542, which affects soldering of the upper row terminal group 54 to the circuit board.

2. The upper shielding sheet 58 and the lower shielding sheet 59 include respectively a main portion 585 and a main portion 595 and a side portion 586 and a side portion 596 bending and extending from each of two sides of the main portion 585 and the main portion 595. The main portion 585 and the main portion 595 are respectively provided with openings 584 and 594 passing through to the side portions 586 and 596. When the first mating plug 5 and the first electrical connecting base 1 are mated, the conducting portions 541 and 551 of the upper row terminal group 54 and the lower row terminal group 55 pass through the terminal slot 5021 to contact the upper shielding sheet 58 or the lower shielding sheet 59 may be avoided.

In summary, the electrical connector assembly according to certain embodiments of the present invention, among other things, has the following beneficial advantages:

(1) The first metal casing 3 is provided with a first accommodating cavity 300 accommodating the first electrical connecting base 1, the second metal casing 4 is provided with a fixing portion 41 fixed to the outer surface of the first metal casing 3, and the second metal casing 4 is provided with a second accommodating cavity 40 accommodating the second electrical connecting base 2, so that it is convenient to separate or combine the first electrical connecting base 1 and the second connecting base 2.

(2) The first metal casing 3 wraps the periphery of the first electrical connecting base 1, and the second metal casing 4 wraps the periphery of the second electrical connecting base 2, so that mutual shielding between the first electrical connecting base 1 and the second electrical connecting base 2 is better.

(3) The top surface of the second metal casing 4 is provided with an elastic sheet 4011 entering the second accommodating cavity 40 downward and used for urging the second mating plug 8 downward, so as to increase stability of cooperation between the second electrical connecting base 2 and the second mating plug 8.

(4) The first electrical connecting base 1 is of a specification of transmitting a USB type C signal, and the second electrical connecting base 2 is of a specification of transmitting a radio frequency signal, so as to implement combined use of the USB type C electrical connector and the radio frequency signal electrical connector.

(5) The insulating sleeve 7 is only sleeved over the mating frame 66, and the insulating sleeve 7 is supported on the circuit board, so that the first mating plug 5 keeps balanced when being soldered to the circuit board.

(6) The bottom surface of the support base 512 of the upper insulating block 51 is provided with a slot 5122 at a side of a soldering portion 542 of the upper row terminal group 54, and the upper insulating block 52 is provided with an isolation portion 5121 between adjacent soldering portions 542. The top surface A of the slot 5122 is higher than the bottom surface of the isolation portion 5121. The slot 5122 may prevent deckle edges and barbs generated at positions at which the upper row terminal group 54 contacts the bottom of the support base 512 from being higher than the soldering surface of the upper row terminal group 54, which affects the soldering of the upper row terminal group 54 to the circuit board.

(7) The upper shielding sheet 58 and the lower shielding sheet 59 are respectively provided with a main portion 585 and a main portion 595, and a side portion 586 and a side portion 596 bending and extending from each of two sides of the main portion 585 and the main portion 595. The main portion 585 and the main portion 595 are respectively provided with openings 584 and 594 passing through to the side portions 586 and 596. When the first mating plug 5 and the first electrical connecting base 1 are mated, the conducting portions 541 and 551 of the upper row terminal group 54 and the lower row terminal group 55 pass through the terminal slot 5021 to contact the upper shielding sheet 58 or the lower shielding sheet 59 may be avoided.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector assembly, comprising:

a first metal casing provided with a first accommodating cavity;

a first electrical connecting base, received in the first accommodating cavity, and configured to mate with a first mating plug;

a second metal casing, fixed onto a circuit board, provided with a second accommodating cavity, and having a fixing portion fixed to an outer surface of the first metal casing; and a second electrical connecting base, received in the second accommodating cavity, and configured to mate with a second mating plug, wherein the first electrical connecting base and the second electrical connecting base are independently formed before respectively received in the first accommodating cavity and the second accommodating cavity, the first metal casing and the second metal casing are fixed via the fixing portion, the first electrical connecting base is fixed to the first metal casing, the second electrical connecting base is fixed to the second metal casing, such that the first electrical connecting base and the second electrical connecting base are assembled together through the first metal casing and the second metal casing; and wherein the first mating plug and the second mating plug are configured to transmit signals of different specifications.

2. The electrical connector assembly according to claim 1, wherein the second accommodating cavity is located at a side of the first metal casing; and wherein the first metal casing wraps the periphery of the first electrical connecting base, and the second metal casing wraps the periphery of the second electrical connecting base.

3. The electrical connector assembly according to claim 1, wherein an extending portion extends from the fixing portion to define the second accommodating cavity, and the head and the tail of the extending portion are connected by laser soldering to form the second accommodating cavity.

4. The electrical connector assembly according to claim 1, wherein the second metal casing comprises a stopping wall extending downward from the fixing portion to be stopped at the back of the first metal casing.

5. The electrical connector assembly according to claim 4, wherein the stopping wall comprises a grounding portion extending downward and soldered to the circuit board.

6. The electrical connector assembly according to claim 1, wherein the second metal casing comprises a stopping portion stopped at the back of the second electrical connecting base.

7. The electrical connector assembly according to claim 1, wherein a top surface of the second metal casing is provided with an elastic sheet entering the second accommodating cavity downward and used for urging the second mating plug downward.

8. The electrical connector assembly according to claim 1, wherein the first electrical connecting base comprises:

a first insulating body, having a first base and a first tongue extending forward from the first base;

a plurality of first terminals and a plurality of second terminals respectively arranged into an upper row and a lower row, and embedded in the first insulating body, each of the first terminals having a first contact portion exposed from an upper surface of the first tongue, and each of the second terminals having a second contact portion exposed from a lower surface of the first tongue;

an upper grounding sheet located above the first terminals;

a lower grounding sheet located below the second terminals and associated with the upper grounding sheet; and a middle shielding sheet located between the first terminals and the second terminals.

9. The electrical connector assembly according to claim 8, wherein the first mating plug comprises a holding sheet contacting the middle shielding sheet, and the holding sheet is provided with an insertion portion extending downward and inserted into the circuit board.

10. The electrical connector assembly according to claim 9, wherein the holding sheet comprises a notch running through a lower edge of the holding sheet, and the holding sheet holds the first mating plug by using the notch.

11. The electrical connector assembly according to claim 1, wherein the second electrical connecting base is of a specification for transmitting a radio frequency signal.

12. The electrical connector assembly according to claim 1, wherein the second metal casing wraps a top surface and two sides of the first metal casing, the fixing portion is fixed to the top surface of the first metal casing by laser soldering, and two buckling sheets extend downward respectively from two side edges of the fixing portion to buckle the two sides of the first metal casing.

13. The electrical connector assembly according to claim 1, wherein the first metal casing comprises a rear wall stopped at the back of the first electrical connecting base, the first electrical connecting base comprises a boss, and the rear wall is provided with a supporting leg extending downward and supported on the boss.

14. The electrical connector assembly according to claim 1, wherein the first mating plug comprises:

a third metal casing, having a fixing frame fixed to the circuit board and a mating frame extending forward from the fixing frame and entering the first accommodating cavity; and an insulating sleeve, sleeved over only the mating frame, having a limiting portion stopped at a front end of the mating frame, and supported on the circuit board.

15. The electrical connector assembly according to claim 1, wherein the first mating plug comprises an insulating block and a terminal group insert-molded in the insulating block;

wherein each terminal of the terminal group comprises a soldering portion, the insulating block comprises an isolation portion between two adjacent soldering portions; and wherein the insulating block comprises, at a side of the soldering portion, a slot extending to the soldering portion, and a top surface of the slot is higher than a bottom surface of the isolation portion.

16. The electrical connector assembly according to claim 1, wherein the first mating plug comprises:

a body;

an upper row of terminals and a lower row of terminals located in the body, each of the upper row of terminals and the lower row of terminals having a conducting portion electrically connected to the first electrical connecting base; and an upper shielding sheet located above the body and a lower shielding sheet located below the body, wherein the upper shielding sheet or the lower shielding sheet comprises a main portion and a side portion bending and extending from each of two sides of the main portion, and the main portion comprises an opening corresponding to the conducting portion and passing through to the side portion.

17. An electrical connector assembly, comprising:

a first metal casing provided with a first accommodating cavity;

a first electrical connecting base, received in the first accommodating cavity, and configured to mate with a first mating plug;

a second metal casing, fixed onto a circuit board, provided with a second accommodating cavity, and having a fixing portion fixed to an outer surface of the first metal casing; and a second electrical connecting base, received in the second accommodating cavity, and configured to mate with a second mating plug, wherein a top surface of the second metal casing is provided with an elastic sheet entering the second accommodating cavity downward and used for urging the second mating plug downward; and wherein the first mating plug and the second mating plug are configured to transmit signals of different specifications.

18. An electrical connector assembly, comprising:

a first metal casing provided with a first accommodating cavity;

a first electrical connecting base, received in the first accommodating cavity, and configured to mate with a first mating plug;

a second metal casing, fixed onto a circuit board, provided with a second accommodating cavity, and having a fixing portion fixed to an outer surface of the first metal casing; and a second electrical connecting base, received in the second accommodating cavity, and configured to mate with a second mating plug, wherein the first metal casing comprises a rear wall stopped at the back of the first electrical connecting base, the first electrical connecting base comprises a boss, and the rear wall is provided with a supporting leg extending downward and supported on the boss; and wherein the first mating plug and the second mating plug are configured to transmit signals of different specifications.

* * * * *